United States Patent [19]

Helms

[11] Patent Number: 5,040,602

[45] Date of Patent: Aug. 20, 1991

[54] INNER STRING CEMENTING ADAPTER AND METHOD OF USE

[75] Inventor: Lonnie C. Helms, Duncan, Okla.

[73] Assignee: Halliburton Company, Duncan, Okla.

[21] Appl. No.: 538,635

[22] Filed: Jun. 15, 1990

[51] Int. Cl.[5] ..... E21B 33/13

[52] U.S. Cl. ..... 166/285; 166/242; 166/290; 166/387

[58] Field of Search ..... 166/285, 290, 242, 387

[56] References Cited

U.S. PATENT DOCUMENTS

| | | | |
|---|---|---|---|
| 2,173,034 | 9/1939 | Armentrout et al. | 166/290 |
| 2,633,201 | 3/1953 | Clark | 166/12 |
| 3,332,499 | 7/1967 | Harris et al. | 166/242 |
| 3,385,372 | 5/1968 | Knox | 166/225 |
| 4,250,966 | 2/1981 | Streich et al. | 166/328 |
| 4,312,405 | 1/1982 | Wilder | 166/285 |
| 4,413,682 | 11/1983 | Callihan et al. | 166/242 |
| 4,474,241 | 10/1984 | Freeman | 166/317 |
| 4,474,243 | 10/1984 | Gaines | 166/242 |
| 4,729,432 | 3/1988 | Helms | 166/317 |
| 4,907,651 | 3/1990 | Bou-Mikael | 166/242 |

OTHER PUBLICATIONS

Halliburton Services Sales & Service Catalog No. 43, published in 1985, pp. 2411–2412.

Halliburton Services Sales & Service Catalog No. 43, published in 1985, pp. 2432–2436.

*Primary Examiner*—Bruce M. Kisliuk

*Attorney, Agent, or Firm*—James R. Duzan; L. Wayne Beavers

[57] ABSTRACT

An inner string cementing adapter for use in cementing a casing in a well bore. The adapter comprises a mandrel which may be attached to a lower end of a work string and a seal assembly positioned adjacent to the mandrel. The seal assembly is designed for sealing engagement with a substantially flat upper surface of floating equipment in the casing. A seal retainer is provided for retaining the seal assembly on the mandrel. The seal assembly comprises a reinforcing insert positioned adjacent to a downwardly facing surface of the mandrel and an elastomeric seal attached to a downwardly facing surface of the insert. The seal is sized such that the outside diameter thereof is larger than a central opening defined in the floating equipment. An inner string cementing tool using the adapter and a method of inner string cementing are also disclosed.

20 Claims, 1 Drawing Sheet

INNER STRING CEMENTING ADAPTER AND METHOD OF USE

BACKGROUND OF THE INVENTION

1. Field Of The Invention

This invention relates to adapters used in inner string cementing and methods of use thereof, and more particularly, to an adapter which has a seal thereon which may be engaged with any floating equipment having a substantially flat upper surface.

2. Brief Description Of The Prior Art

A frequently used method of cementing casing strings is inner string cementing which is performed by pumping cement through a work string, such as a drill pipe which has been run inside the casing, rather than pumping cement through the casing itself. Inner string cementing is particularly useful for large casings and casing at extreme depths because it minimizes the amount of cement that has to be drilled out of large diameter casing or deep casing compared to cementing in the conventional manner.

Inner string cementing is illustrated in Halliburton Services Sales & Service Catalog No. 43, pages 2411–2412, published in 1985. A sealing adapter is attached to the end of the work string, such as the drill string or other small diameter pipe, and the adapter has a seal thereon which engages the corresponding floating, guiding or baffle equipment (collectively referred to herein as "floating equipment") on the casing string. When sealingly engaged, cement is pumped through the small diameter pipe, rather than through the casing itself, and discharged through a float collar, float shoe or other device.

One such inner string cementing tool consists of a stab-in type sealing adapter which is designed to enter into, seat and seal inside any Halliburton floating equipment using a molded plastic seat insert. The adapter is attached to the inner string immediately below a special centralizer which keeps the adapter centrally located in the casing. Another tool consists of a special baffle collar, float collar or float shoe which has a sealing sleeve molded into the concrete. The concrete molding has a chamfered surface to help guide or pilot the sealing adapter into the sealing sleeve. Still another type of cementing tool incorporates a special baffle collar which has a built-in latch-down baffle molded into the concrete. The concrete portion has a chamfer to aid in insertion of the sealing adapter. A latch-down plug may be pumped down the inner string and latched into the baffle collar.

In all of these devices, sealing engagement must be obtained at the end of the work string so that cement is displaced through the floating equipment and into the annular space between the casing and well bore rather than leaking into the annular space between the work string and the casing.

There are many advantages to inner string cementing. As previously mentioned, the amount of cement used is minimized. Further, large cementing plugs or plug containers are not necessary, and when no cementing plugs are used, drilling out of the cement is simplified. When cement is pumped down the inner string, there is less likelihood of contamination from the drilling mud, and inner string cementing also provides more rapid placement of the cement.

The inner string cementing tools previously described have worked well, but they do require the insertion of an adapter into a smooth bore in the floating equipment. Such insertion requires a separately sized adapter for each size of bore in the floating equipment. There is a need for a cementing adapter which is not required to be specially sized for particular bores, and there is also a need for an adapter which may be used on floating equipment which does not have a smooth bore therein. The present invention meets these needs by providing an adapter which is universal for virtually any floating equipment which has a substantially flat upper surface and which an orifice or opening which is smaller than the outside diameter of the adapter seal.

SUMMARY OF THE INVENTION

The inner string cementing adapter of the present invention is designed for use on a work string in cementing a well casing having floating equipment therein. Generally, the adapter comprises mandrel means for connecting to a lower end of the work string and sealing means adjacent to the mandrel means for substantially flatly sealing against a surface of the floating equipment. The adapter may further comprise retaining means for retaining the sealing means in an operating position on the mandrel means. In one embodiment, the retaining means is threadedly engaged with the mandrel means.

In the preferred embodiment, the sealing means is characterized by a seal assembly comprising a reinforcing insert positioned against the mandrel means and a substantially elastomeric seal attached to the reinforcing insert. The retaining means may be characterized by a seal retainer attached to the mandrel means and adapted for clampingly engaging a portion of the seal assembly. The reinforcing insert preferably has a portion which extends radially outwardly from the elastomeric seal, and the seal retainer has an inwardly extending flange portion for clamping against the outwardly extending portion of the reinforcing insert.

The adapter may further comprise positioning or locating means for radially positioning the sealing means with respect to the mandrel means. The positioning means may be characterized by a substantially cylindrical portion of the adapter means which extends downwardly therefrom and into the seal assembly.

A second sealing means may be provided for sealing between the mandrel means and the retaining means. This second sealing means may be characterized by an O-ring.

The present invention may also be said to include an inner string cementing tool which comprises a work string, a centralizer attached to a lower portion of the work string, and an adapter. The adapter comprises a mandrel attached to a lower end of the work string, a seal assembly positioned adjacent to a lower end of the mandrel, and retaining means for retaining the seal assembly on the mandrel. The seal assembly is adapted for sealing engagement with a substantially flat upper surface of floating equipment in the well casing.

The apparatus of the present invention may be used in a method of cementing a well casing in a well bore which comprises the steps of positioning a floating equipment device in the well casing wherein the floating equipment device has a substantially flat upper surface thereon, attaching a cementing adapter to a lower end of the work string wherein the cementing adapter has a downwardly facing seal thereon, lowering the work string into the casing, centrally positioning the adapter in the casing as the work string is lowered, engaging the seal on the cementing adapter with the flat upper surface of the floating equipment device such that substantially leak-free engagement is provided therebetween, and pumping cement downwardly through the work string, adapter and floating equipment device. The method may further comprise the steps of ceasing pumping of the cement and raising the work string such that the leak-free engagement is broken. The method may still further comprise the step of rigidly supporting the seal on the adapter for preventing the seal from being pumped free when cement is pumped downwardly therethrough and sizing the seal on the adapter such that it has an outside diameter larger than an opening defined through the flat upper surface of the floating equipment device.

An important object of the present invention is to provide an inner string cementing adapter which has sealing means for flatly sealing against a flat surface of floating equipment positioned in a well casing.

Another object of the present invention is to provide an inner string cementing tool which does not require a cementing adapter to be inserted into a smooth bore in well casing floating equipment.

A further object of the invention is to provide an improved method of inner string cementing for a well casing in a well bore.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
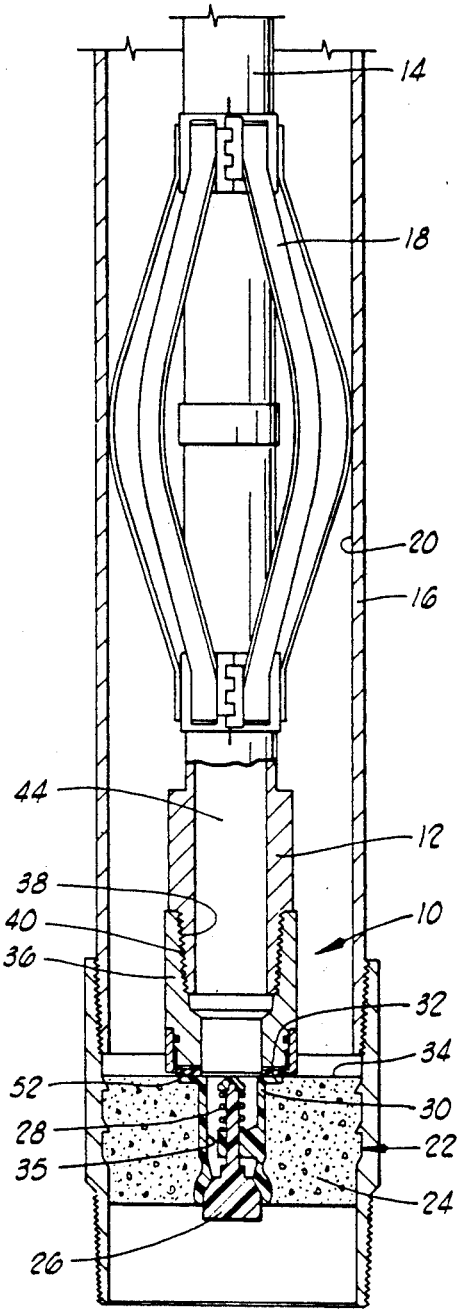
FIG. 1 illustrates the inner string cementing adapter of the present invention attached to the end of a work string and positioned in a well casing in sealing engagement with a float collar or other floating equipment.

Referring now to the drawings, and more particularly to FIG. 1, the inner string cementing adapter of the present invention is shown and generally designated by the numeral 10. As will be further discussed herein, adapter 10 is attached to a lower connector portion 12 of a work string 14. Work string 14, which may be a drill string or other pipe string, is positioned in a well casing 16.

Work string 14 has a centralizer 18 thereon which is positioned above connector 12. Centralizer 18 is of a kind known in the art adapted to engage bore 20 in casing 16 and radially position adapter 10 to maintain the adapter substantially coaxial with a float collar 22 or other such floating equipment positioned in or on casing 16. Float collar 22 as illustrated is a Halliburton Services Super Seal II float collar which is known in the art. As will be further discussed herein, adapter 10 may be used with any floating equipment having a substantially flat upper surface, and the invention is not intended to be limited to the particular float collar 22 shown. As used herein, the term "floating equipment" includes any device referred to as floating, guiding or baffle equipment in the industry. Floating equipment is a term which is commonly used in the industry for any such device.

Float collar 22 has a body portion 24, generally made of concrete, with a back check valve 26 therein. Valve 26 is biased upwardly to the closed position illustrated by a biasing means, such as spring 28. At the upper end of float collar 22 is an insert 30 which is preferably molded into concrete body 24. Insert 30 has a substantially flat upper surface 32 which may be substantially flush with upper surface 34 of body 24. A bore 35 is defined in insert 30. Floating equipment without any insert may also be used as long as there is a substantially flat surface. Further, it is not necessary for bore 35 to be smooth.

Figure 2:
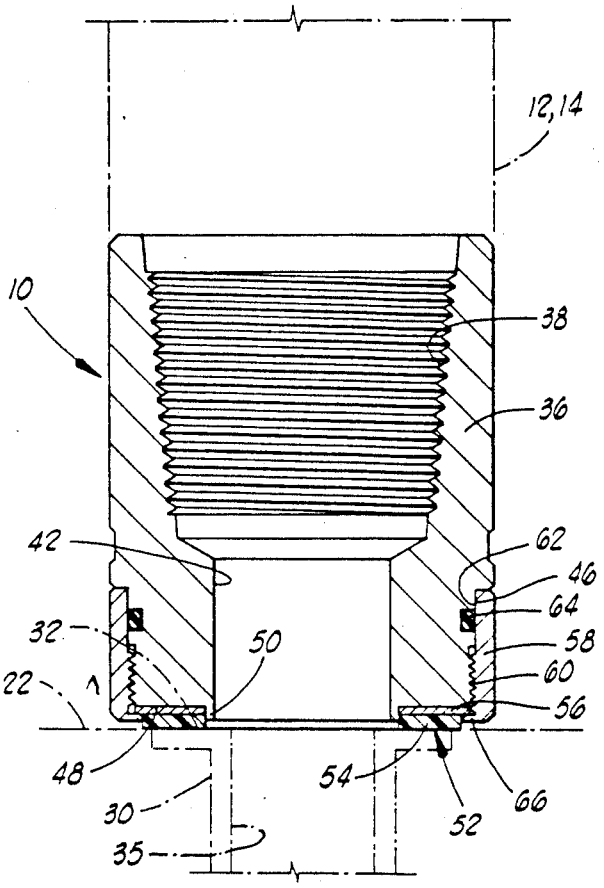
FIG. 2 is a detailed cross-sectional view of the inner string cementing adapter.

Referring now also to FIG. 2, adapter 10 comprises a mandrel means, such as mandrel 36, having a threaded bore 38 in the upper end thereof which is adapted for engagement with threaded surface 40 on connector 12. The lower end of mandrel 36 defines a bore 42 therein which is fluid communication with central opening 44 in work string 14.

Mandrel 36 has a recessed outside diameter 46 thereon. The lower end of mandrel 36 includes a downwardly facing annular surface 48 with a substantially cylindrical portion 50 extending therebelow.

Positioned adjacent to surface 48 and cylindrical portion 50 is a first or primary sealing means, such as seal assembly 52. The illustrated embodiment of seal assembly 52 comprises an elastomeric seal 54 and a reinforcing insert 56 attached thereto. Seal 54 and reinforcing insert 56 are preferably attached by bonding the two parts together during curing of the elastomeric material of the seal, although other attaching techniques may be used.

The inside diameters of seal 54 and reinforcing insert 56 are generally guided and located on cylindrical portion 50 of mandrel 36. Thus, cylindrical portion 50 provides a positioning or locating means for radially positioning seal assembly 52 with respect to mandrel 36. Reinforcing insert 56 is positioned against surface 48 of mandrel 36, and the outside diameter of the reinforcing insert is larger than the outside diameter of seal 54. Thus, reinforcing insert 56 extends radially outwardly from seal 54.

A retaining means, such as a seal retainer 58, is attached to mandrel 36 at threaded connection 60. Retainer 58 has a bore 62 therein which is in close, spaced relationship with outside diameter 46 of mandrel 36. A second sealing means, such as O-ring 64, provides sealing engagement between seal retainer 58 and mandrel 36.

At the lower end of seal retainer 58 is an inwardly directed flange 66 having an inside diameter in close relationship to the outside diameter of seal 54. As threaded connection 60 is made up, flange 66 is adapted to clampingly engage the portion of reinforcing insert 56 which extends radially outwardly from seal 54. Thus, a means is provided for retaining seal assembly 52 in its operating position on mandrel 36.

OPERATION OF THE INVENTION

Once casing 16 is positioned in the well bore and a cementing operation is desired, work string 14 is lowered into the casing. Centralizer 18 keeps work string 14 in a generally central position within casing 16, and in particular, maintains adapter 10 in a position which is generally coaxial with bore 35 in float collar 22.

Work string 14 is lowered until seal 54 of seal assembly 52 on adapter 10 sealingly engages upper surface 32 of insert 30 in float collar 22. Since seal assembly 52 is adapted for sealing, substantially leak-free engagement with any substantially flat surface having a bore 35 smaller than the outside diameter of seal 54, the sealing engagement is easily maintained and it is not necessary to insert the adapter into bore 35 as in the prior art. In other words, precise alignment between seal assembly 52 and bore 35 in float collar 22 is not necessary.

The sealing engagement of seal 54 on insert 30 is maintained by keeping weight on work string 14, and cement is pumped downwardly through the work string and thus through bore 42 in mandrel 36 of adapter 10 and further into float collar 22. The cement forces back check valve 26 open to allow cement to flow through float collar 22 in a manner known in the art. The cement then flows below float collar 22 to complete the cementing operation, also in a manner known in the art.

During cementing, seal retainer 58 and the support provided by reinforcing insert 56 act to contain seal 54 sufficiently that it is not pumped out.

When sufficient cement has been pumped downwardly through work string 14, pumping is stopped, and back check valve 26 recloses. At this point, the sealing engagement between seal 54 and insert 30 may be broken by raising work string 14 out of casing 16. Other typical inner string cementing operations may be carried out using the apparatus of the present invention.

It will be seen, therefore, that the inner string cementing adapter of the present invention and method of use thereof are well adapted to carry out the ends and advantages mentioned as well as those inherent therein. While a presently preferred embodiment of the invention has been shown for the purposes of this disclosure, numerous changes in the arrangement and construction of parts may be made by those skilled in the art. All such changes are encompassed within the scope and spirit of the appended claims.

What is claimed is:

1. An inner string cementing adapter for use on a work string in a well casing having floating equipment therein, said adapter comprising:

mandrel means for connecting to a lower end of the work string; and sealing means adjacent to said mandrel means for substantially flatly sealing against a surface of the floating equipment without engaging a central opening in said floating equipment.

2. The adapter of claim 1 further comprising retaining means for retaining said sealing means in an operating position on said mandrel means.

3. The adapter of claim 2 wherein said retaining means is threadedly engaged with said mandrel means.

4. The adapter of claim 2 further comprising a second sealing means for sealing between said mandrel means and said retaining means.

5. The adapter of claim 1 further comprising positioning means for radially positioning said sealing means with respect to said mandrel means.

6. The adapter of claim 5 wherein said positioning means is characterized by a substantially cylindrical portion extending downwardly from said adapter means.

7. An inner string cementing adapter for use on a work string in a well casing having floating equipment therein, said adapter comprising:

mandrel means for connecting to a lower end of the work string; and sealing means adjacent to said mandrel means for substantially flatly sealing against a surface of the floating equipment, said sealing means being characterized by a seal assembly comprising:

a reinforcing insert positioned against said mandrel means; and a substantially elastomeric seal attached to said reinforcing insert.

8. The adapter of claim 7 further comprising a seal retainer attached to said mandrel means and adapted for clampingly engaging a portion of said seal assembly.

9. The adapter of claim 8 wherein:

said reinforcing insert has a portion which extends radially outwardly from said elastomeric seal; and said seal retainer has an inwardly extending flange portion for clamping against said portion of said reinforcing insert.

10. An inner string cementing tool for use in a well casing having floating equipment therein, said tool comprising:

a work string;

a centralizer attached to a lower portion of said work string; and an adapter comprising:

a mandrel attached to a lower end of said work string;

a seal assembly positioned adjacent to a lower end of said mandrel, said seal assembly being adapted for sealing engagement with a substantially flat upper surface of said floating equipment without extending into a central opening of said floating equipment; and retaining means for retaining said seal assembly on said mandrel.

11. The tool of claim 10 wherein said retaining means is characterized by a seal retainer threadingly engaged with said mandrel.

12. The tool of claim 10 further comprising sealing means for sealing between said mandrel and said retaining means.

13. An inner string cementing tool for use in a well casing having floating equipment therein, said tool comprising:

a work string;

a centralizer attached to a lower portion of said work string; and an adapter comprising:

a mandrel attached to a lower end of said work string;

a seal assembly positioned adjacent to a lower end of said mandrel, said seal assembly being adapted for sealing engagement with a substantially flat upper surface of said floating equipment wherein said seal assembly comprises:

a reinforcing insert positioned adjacent to a downwardly facing surface of said mandrel; and an elastomeric seal attached to a downwardly facing surface of said reinforcing insert; and retaining means for retaining said seal assembly on said mandrel.

14. The tool of claim 13 wherein said adapter comprises a cylindrical portion extending downwardly from said downwardly facing surface thereof, said cylindrical portion providing an internal guide for said reinforcing insert and said seal.

15. The tool of claim 13 wherein said retaining means comprises an inwardly directed flange adapted for clampingly engaging a portion of said reinforcing insert.

16. The tool of claim 15 wherein said portion of said reinforcing insert extends radially outwardly from said seal.

17. A method of cementing a well casing in a well bore, said method comprising the steps of:

positioning a floating equipment device in said casing, said floating equipment device having a substantially flat upper surface thereon and defining an opening in said flat upper surface;

attaching a cementing adapter to a lower end of a work string, said cementing adapter having a downwardly facing seal thereon;

lowering said work string into said casing;

centrally positioning said adapter in said casing as said work string is lowered;

engaging said seal with said flat upper surface of said floating equipment device without engaging said opening such that a substantially leak-free engagement is provided between said seal and said flat upper surface; and pumping cement downwardly through said work string, said adapter and said opening in said floating equipment device.

18. The method of claim 17 further comprising the steps of:

ceasing pumping of said cement; and raising said work string such that said leak-free engagement is broken.

19. The method of claim 17 further comprising the step of rigidly supporting said seal on said adapter for preventing said seal from being pumped free.

20. The method of claim 17 further comprising sizing said seal to have an outside diameter larger than said opening defined in said flat upper surface of said floating equipment.

* * * * *